US007467039B2

(12) United States Patent
Adachi et al.

(10) Patent No.: US 7,467,039 B2
(45) Date of Patent: Dec. 16, 2008

(54) REVOLUTION CONTROL APPARATUS FOR AN INTERNAL COMBUSTION ENGINE, AND INTERNAL COMBUSTION ENGINE PROVIDED WITH THAT REVOLUTION CONTROL APPARATUS

(75) Inventors: Hitoshi Adachi, Osaka (JP); Tomohiro Otani, Osaka (JP); Fumiya Kotou, Osaka (JP); Hideo Shiomi, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 18 days.

(21) Appl. No.: 11/631,956

(22) PCT Filed: May 19, 2005

(86) PCT No.: PCT/JP2005/009146

§ 371 (c)(1),
(2), (4) Date: Jan. 9, 2007

(87) PCT Pub. No.: WO2006/006301

PCT Pub. Date: Jan. 19, 2006

(65) Prior Publication Data

US 2007/0227505 A1 Oct. 4, 2007

(30) Foreign Application Priority Data

Jul. 12, 2004 (JP) ..... 2004-204347

(51) Int. Cl.
*F02D 29/00* (2006.01)

(52) U.S. Cl. ..... 701/101; 701/103; 123/472

(58) Field of Classification Search ..... 123/319, 123/332, 472, 436, 399, 339.1, 339.12; 701/101, 701/103, 104, 105
See application file for complete search history.

(56) References Cited

U.S. PATENT DOCUMENTS

| | | | | |
|---|---|---|---|---|
| 4,893,600 | A * | 1/1990 | Holmes | 123/406.2 |
| 5,263,364 | A * | 11/1993 | Nakayama et al. | 73/116 |
| 5,539,644 | A * | 7/1996 | Ichikawa et al. | 701/111 |
| 5,819,197 | A * | 10/1998 | Fiaschetti et al. | 701/110 |
| 6,334,094 | B1 * | 12/2001 | Hirakata et al. | 702/145 |
| 6,755,176 | B2 * | 6/2004 | Takeuchi et al. | 123/299 |
| 7,025,043 | B2 * | 4/2006 | Tonetti et al. | 123/436 |

FOREIGN PATENT DOCUMENTS

| | | |
|---|---|---|
| JP | 8-155229 | 9/1983 |
| JP | 63-71542 | 3/1988 |
| JP | 7-77091 | 3/1995 |
| JP | 10-184431 | 7/1998 |
| JP | 2000-205021 | 7/2000 |

* cited by examiner

*Primary Examiner*—Willis R. Wolfe, Jr.
*Assistant Examiner*—Johnny H. Hoang
(74) *Attorney, Agent, or Firm*—Edwards Angell Palmer & Dodge LLP

(57) ABSTRACT

An engine revolution in an expansion stroke of a cylinder is calculated, and stored, from a time that is required for a crank shaft to rotate by a predetermined angle from a compression upper dead center of that cylinder, and to determine the fuel injection amount, in averaging these stored revolutions from the cylinder immediately prior to a cylinder before the cylinder that is immediately prior to obtain a revolution that serves as the engine revolution, how many past cylinders are retroactively averaged is switched according to the engine operation state.

8 Claims, 5 Drawing Sheets

REVOLUTION CONTROL APPARATUS FOR AN INTERNAL COMBUSTION ENGINE, AND INTERNAL COMBUSTION ENGINE PROVIDED WITH THAT REVOLUTION CONTROL APPARATUS

BACKGROUND OF THE INVENTION

1. Field of the Invention

The invention relates to revolution control apparatuses for internal combustion engines (such as diesel engines), and internal combustion engines (hereinafter, referred to as engines) provided with those revolution control apparatuses. In particular, the invention relates to measures for balancing an increase in the responsiveness of the fuel injection system that determines the fuel injection amount through so-called revolution feedback control, and the stability of engine operation.

2. Description of the Related

In the past, the fuel supply systems of multi-cylinder diesel engines disclosed, for example, in Patent Documents 1 and 2 listed below have determined the fuel injection amount from the fuel injection valves through electric control. One example of a method for determining the fuel injection amount has also been to adjust the fuel injection amount according to the manner in which the engine revolution fluctuates. That is, so-called engine revolution feedback control is performed in which the prior engine revolution is recognized when computing the necessary fuel injection amount, and if this recognized engine revolution is lower than a target revolution, then the fuel injection amount is increased, and if this engine revolution is higher than a target revolution, then the fuel injection amount is reduced.

One example of how engine revolution feedback control has been performed to date has been to calculate the engine revolution in the expansion stroke of a cylinder from the time that is required for the crank shaft to rotate by a predetermined angle from the compression upper dead center of that cylinder, and from this to recognize the current engine revolution and then compare the current engine revolution with the target revolution to determine the fuel injection amount. Hereinafter, this engine revolution feedback control is referred to as "immediately prior cylinder feedback control."

Another example has been to calculate the engine revolution in the expansion stroke of a cylinder from the time that is required for the crank shaft to rotate by a predetermined angle from the compression upper dead center of the cylinder, and from this to recognize that the average value of the revolutions from the cylinder immediately prior to a cylinder before the cylinder immediately prior is the current engine revolution and then compare the current engine revolution with the target revolution in order to determine the fuel injection amount. Hereinafter, this engine revolution feedback control is referred to as "multiple average feedback control."

Patent Document 1: JP 2001-41090A

Patent Document 2: JP 2002-371889A

SUMMARY OF THE INVENTION

However, the conventional engine revolution feedback controls mentioned above have the following problems.

Performing "immediately prior cylinder feedback control" increases the responsiveness to changes in the target revolution, but when this control is performed when the engine is in a steady operation state, the fuel injection amount of the cylinders alternates between big and small and this increases the discrepancy in the exhaust temperatures of the cylinders.

FIG. 6 shows the relationship between the cylinder number and the exhaust temperature in a case where there the discrepancy in exhaust temperatures of cylinders in a four-cylinder engine has increased. In the case shown in FIG. 6, the expansion stroke occurs in the order of first, third, fourth, then second cylinders. Here, if, for example, the engine load is temporarily reduced, then the fuel injection amount in the first cylinder is reduced and thus the engine revolution is reduced and the exhaust temperature drops. Then, in the third cylinder, which performs the next expansion stroke, the fuel injection amount is increased in order to recover the drop in engine revolution in the first cylinder, and as the result the engine revolution increases and the exhaust temperature rises also. Thereafter, the fuel injection amount of each cylinder alternates between big and small, and FIG. 6 shows a state in which the discrepancy in exhaust temperature between cylinders has become large.

If reduced-cylinder operation occurs due to cylinder failure, for example, then the fuel injection amount in the cylinder immediately after the stalled cylinder will be too high, and this may result in hatching. FIG. 7 shows how the engine revolution fluctuates when, for example, a carbon flower occurs in the fuel injection valve of the first cylinder and prevents the supply of fuel to the first cylinder (=a reduced-cylinder operation state). In this diagram, "#" denotes the cylinder number, and "TDC" denotes the timing at which the piston of that cylinder reaches the compression upper dead center. As can be understood from FIG. 7, when the stroke advances from the compression upper dead center of the first cylinder to the next compression upper dead center, which is the compression upper dead center of the third cylinder (the range t1 in the drawing), combustion within the first cylinder is incomplete and thus the engine revolution drops. Then, the fuel injection amount is significantly increased for the third cylinder to compensate for the drop in engine revolution in the first cylinder, and thus the engine revolution suddenly rises (see p1 in the drawing). Subsequently, the fluctuation in the fuel injection amount in the cylinders becomes large and leads to repeated sudden changes in the engine revolution, resulting in hatching.

On the other hand, in the case of fuel injection systems that perform "multiple average feedback control," the problem of the "immediately prior cylinder feedback control" discussed above does not occur. However, there is a drop in the responsiveness to load fluctuation and commands to change the target revolution when accelerating and decelerating. That is, the engine revolution in the expansion stroke of a cylinder is calculated from the time that is required for the crank shaft to rotate by a predetermined angle from the compression upper dead center of that cylinder, and from this the average value of the revolutions from the cylinder immediately prior to a cylinder before the cylinder immediately prior is regarded as the current engine revolution and the fuel injection amount is determined by comparing the current engine revolution with the target revolution, and thus a time lag occurs before control that reflects the sudden load fluctuation or target revolution change command when accelerating or decelerating (control to rapidly increase the fuel injection amount to bring the engine revolution closer to the target revolution) is performed. FIG. 5(*b*) shows how the engine revolution fluctuates in a case where the instructed revolution (target revolution) has suddenly risen in a fuel injection system that performs "multiple average feedback control" (FIG. 5(*a*) shows the change in the instructed revolution signal). It can be understood from FIG. 5(*b*) that a time lag (time t2 in the drawing) occurs between the moment that the instructed revolution signal rises suddenly and the point at which the instructed revolution actually rises, and subsequent to this as well, a long time (time t3 in the drawing) is required before the actual instructed revolution settles at the instructed revolution.

The present invention was arrived at in light of the foregoing matters, and it is an object thereof to provide a revolution control apparatus, and an internal combustion engine provided with that revolution control apparatus, that achieves a fuel injection operation through which a balance between an improvement in responsiveness during periods of transition such when the load is fluctuating and when a command has been made for acceleration or deceleration, and an improvement in operation stability when the engine is in a steady state can be attained.

—Overview of the Invention—

One solution of the invention for achieving the above object is to switch how control is performed to determine the fuel injection amount in accordance with the engine operation state. For example, in an operation state in which there is little discrepancy among the exhaust temperatures of the cylinders, the fuel injection amount may be determined through control ("immediately prior cylinder feedback control") that allows sudden fluctuations in load to be followed, and in an operation state in which there is a large discrepancy in the exhaust temperatures of the cylinders, the fuel injection amount may be determined by switching to control ("multiple average feedback control") that places priority on inhibiting discrepancies in the exhaust temperature rather than how well the fluctuation load is followed.

—Means for Solution—

Specifically, a prerequisite of the invention is a revolution control apparatus of an internal combustion engine that performs engine revolution feedback control in which an engine revolution of an internal combustion engine, which has a plurality of cylinders, is detected and the fuel injection amount from fuel injection means is controlled so that the detected engine revolution approaches a target revolution. This revolution control apparatus is furnished with revolution calculation and storage means for calculating, from a time that is required for a crank shaft to rotate by a predetermined angle from a compression upper dead center of each cylinder, the engine revolution in an expansion stroke of that cylinder, and stores this in association with that cylinder number, and feedback revolution switching means that, in determining the fuel injection amount based on the engine revolution that has been associated with that cylinder number and the target revolution, feeds back a revolution that is obtained by retroactively averaging the stored revolutions from the cylinder immediately prior to a cylinder before the cylinder that is immediately prior as the engine revolution, and calculates a feedback revolution by switching the number of retroactive cylinders according to an operation state of the internal combustion engine.

With these specific features, it is possible to select an appropriate feedback revolution that is suited for the operation state of the internal combustion engine. For example, if a sudden load fluctuation occurs, then it is possible to determine the fuel injection amount based on only the revolution of the cylinder immediately prior so as to inject an amount of fuel that corresponds to this load fluctuation from the fuel injection means without a time lag. Conversely, when the target revolution or the engine load is stable, such as during a steady operation state, the fuel injection amount is determined based on a revolution that is obtained by retroactively averaging the revolutions up to a cylinder that is before the cylinder immediately prior so as to inhibit fluctuation in the fuel injection amount due to an oversensitive response to an instantaneous disturbance and thus permits stable engine operation.

It should be noted that here the predetermined angle is one half of the angle from the compression upper dead center of one cylinder to the compression upper dead center of the next cylinder.

The operation of the feedback revolution switching means for switching the feedback revolution is described in specific detail below.

In the above configuration, it is also possible for the feedback revolution switching means to switch the number of retroactive cylinders for calculating the average revolution to feed back according to the engine load. In this case, the number of retroactive cylinders to be averaged is switched according to the engine load, and thus it is possible to achieve operation with good responsiveness and stability that is suited for the state of the engine load.

It is also possible for the conditions for determining whether or not to feed back the revolution that is obtained by averaging the revolutions from the cylinder immediately prior to a cylinder before the cylinder that is immediately prior to be whether or not the internal combustion engine is in a steady operation state.

Further, as one example of how to select a feedback revolution according to fluctuations in the target revolution, it is also possible that the feedback revolution switching means performs switching according to an amount of deviation between the target revolution and the engine revolution in the cylinder immediately prior. At this time, it reduces the number of retroactive cylinders if the amount of deviation is large and increases the number of retroactive cylinders if the amount of deviation is small so as to allow a fuel injection amount that mirrors the fluctuation in the target revolution to be obtained quickly, and in situations where a sudden jump in engine revolution, such as when abruptly accelerating, is required, that demand can be met quickly to achieve operation that has good responsiveness.

Further, as another example of how to select the feedback control method according to fluctuation in the engine load, it is also possible for the feedback revolution switching means to performing switching according to the amount of fluctuation in the engine load. By reducing the number of retroactive cylinders if the amount of fluctuation is large and increasing the number of retroactive cylinders if the amount of fluctuation is small, it is possible to quickly obtain a fuel injection amount that mirrors the fluctuation in the load, and in particular, even in a situation where the load abruptly increases when the internal combustion engine is operating at low angular velocity and causes the engine revolution to drop suddenly, the fuel injection amount can be rapidly increased to maintain the engine revolution, and thus operation with good responsiveness can be achieved even when the engine load fluctuates.

In addition, it is also possible that the feedback revolution switching means feeds back the revolution that is obtained by retroactively averaging the revolutions from the cylinder immediately prior to a cylinder before the cylinder that is immediately prior when operating under a reduced number of cylinders. Thus, it is possible to keep hatching of the fuel injection amount from occurring due to a marked increase in the fuel injection amount in the cylinder following a stopped cylinder, and this makes it possible to alleviate discrepancies in the exhaust temperature among the cylinders.

In regard to finding the average revolution from the cylinder immediately prior to a cylinder before the immediately prior cylinder, the number of retroactive cylinders may be an integer multiple of the number of engine cylinders. Thus, the engine revolution in the expansion stroke of all cylinders of the internal combustion engine is reflected in the feedback revolution, so that the effects of rotation fluctuation can be eased regardless of the target revolution or the engine load in the revolution.

Further, it is also possible that the feedback revolution switching means feeds back the engine revolution of the cylinder immediately prior when the internal combustion engine is idling. Doing this improves the responsiveness to acceleration commands and fluctuations in the engine load.

Further, if the feedback revolution switching means has estimated the fluctuation in the engine load from a clutch disengage signal, etc., then it can feed back the engine revolution of the cylinder immediately prior during a predetermined load correspond period. Doing this allows drops in engine rotation during load fluctuation to be inhibited. In this case, it is preferable that the load correspond period can be set freely. Thus, even if the period from a fluctuation in the load until the transition to a constant operation state differs for each internal combustion engine depending on the engine type, individual differences or wear due to age, adjustments for such individual differences and wear due to age are possible.

In addition, the scope of the technical idea of the invention also includes an internal combustion engine that is furnished with any one of the revolution control apparatuses presented in the above means for solution.

As illustrated above, in the invention the engine revolution that is feed back in order to determine the fuel injection amount is a revolution that is obtained by averaging the revolution from the cylinder immediately prior to a cylinder before that cylinder immediately prior, and this allows the number of previous cylinders to be used to calculate the average to be switched according to the engine operation state, and by selecting the feedback revolution, it is possible to achieve a balance between an increase in responsiveness during periods of transition such as load fluctuation and when an acceleration or deceleration command has been made, and an increase in operation stability when the internal combustion engine is in a steady operation state.

DESCRIPTION OF REFERENCE NUMERALS

1 injector (fuel injection valve)
12C revolution calculation and storage means
12D feedback revolution switching means
12E target revolution determination means
12F load fluctuation determination means
12G reduced cylinder operation determination means
E engine (internal combustion engine)

DETAILED DESCRIPTION OF EXEMPLARY EMBODIMENTS

Embodiments of the present invention will now be described with reference to the drawings. The following embodiments describe cases in which the present invention has been adopted for a four-cylinder marine diesel engine provided with an accumulator (common rail type) fuel injection apparatus that is furnished with an accumulator pipe ("common rail").

—Description of the Fuel Injection Apparatus Configuration—

Figure 1:
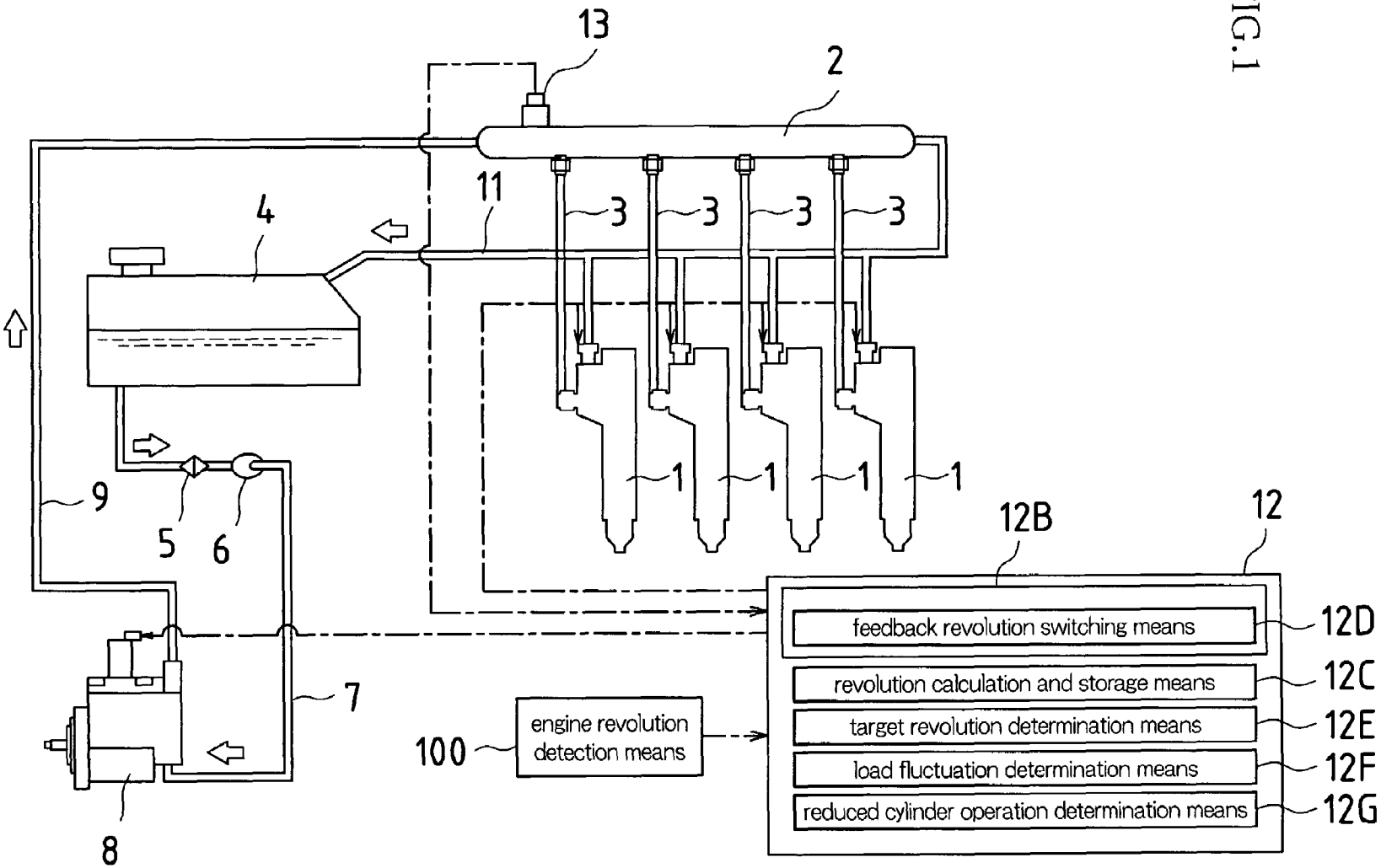
FIG. 1 is a diagram showing the accumulator fuel injection apparatus according to an embodiment.

The overall configuration of the fuel injection apparatus that is employed in the engine according to this embodiment is described first. FIG. 1 shows an accumulator fuel injection apparatus that is provided in a four-cylinder marine diesel engine.

This accumulator fuel injection apparatus is provided with a plurality of fuel injection valves (hereinafter, referred to simply as injectors) 1 each of which is attached to a corresponding cylinder of a diesel engine (hereinafter, referred to simply as engine), a common rail 2 that accumulates high-pressure fuel that is at relatively high pressure (common rail pressure: 100 MPa, for example), a high-pressure pump 8 that pressurizes the fuel that is sucked from a fuel tank 4 by a low-pressure pump (feed pump) 6 to a high pressure and then ejects it into the common rail 2, and a controller (ECU) 12 for electrically controlling the injectors 1 and the high-pressure pump 8.

The high-pressure pump 8 is, for example, a so-called plunger-type supply fuel supply pump that is driven by the engine and steps up the fuel to a high pressure that is determined based on the operation state, for example, and supplies this to the common rail 2 through a fuel supply line 9.

Each injector 1 is attached to the downstream end of a fuel pipe each of which is in communication with the common rail 2. The injection of fuel from the injectors 1 is controlled by supplying and cutting off electricity (ON/OFF) to an injection control solenoid valve, which is not shown, that for example is incorporated into a single unit with the injector. That is, the injector 1 injects the high-pressure fuel that has been supplied from the common rail 2 toward the combustion chamber of the engine a while its injection control solenoid valve is open.

The controller 12 is furnished with various types of engine information such as the engine revolution and the engine load, and outputs a control signal to the injection control solenoid valve so as to obtain the most suitable fuel injection timing and fuel injection amount determined from these signals. At the same time, the controller 12 outputs a control signal to the high-pressure pump 8 so that the fuel injection pressure becomes an ideal value for the engine revolution or the engine load. Further, a pressure sensor 13 for detecting the common rail pressure is attached to the common rail 2, and the fuel ejection amount that the high-pressure pump 8 ejects to the common rail 2 is controlled so that the signal of the pressure sensor 13 becomes a preset ideal value for the engine revolution or engine load.

The supply of fuel to each injector 1 is performed through a branched pipe 3 that constitutes a portion of the fuel channel from the common rail 2. That is, the fuel is drawn from the fuel tank 4 through a filter 5 by the low-pressure pump 6 and pressurized to a predetermined intake pressure and then delivered to a high-pressure pump 8 through the fuel pipe 7. The fuel that has been supplied to the high-pressure pump 8 is collected in the common rail 2 still pressurized to the predetermined pressure, and from the common rail 2 is supplied to each injector 1. A plurality of injectors 1 are provided according to the engine type (number of cylinders; in this embodiment, four cylinders), and under the control of the controller 12, the injectors 1 inject the fuel that has been supplied from the common rail 2 to the corresponding combustion chamber at an optimum injection timing at an optimum fuel injection amount (the method for determining the fuel injection amount is discussed later). The injection pressure at which the fuel is injected from the injectors 1 is substantially equal to the pressure of the fuel being held in the common rail 2, so that the fuel injection pressure is controlled by controlling the pressure within the common rail 2.

Fuel that is supplied to the injectors 1 from the branched pipe 3 but is not used up in the injection to the combustion chamber, or excess fuel if the common rail pressure has risen too high, is returned to the fuel tank 4 through a return pipe 11.

The controller 12, which is an electric control unit, is supplied with information on the cylinder number and the crank angle. The controller 12 stores, as functions, the target fuel injection conditions (for example, the target fuel injection timing, the target fuel injection amount, and the target common rail pressure), which are determined in advance based on the engine operation state so that the engine output becomes the optimum output for the drive condition, and finds the target fuel injection conditions (that is, the fuel injection timing and the injection amount for the injector 1) that corresponds to the signals that indicate the current engine operation state detected by various sensors, and then controls the operation of the injectors 1 and the fuel pressure within the common rail so that fuel injection is performed under those conditions.

Figure 2:
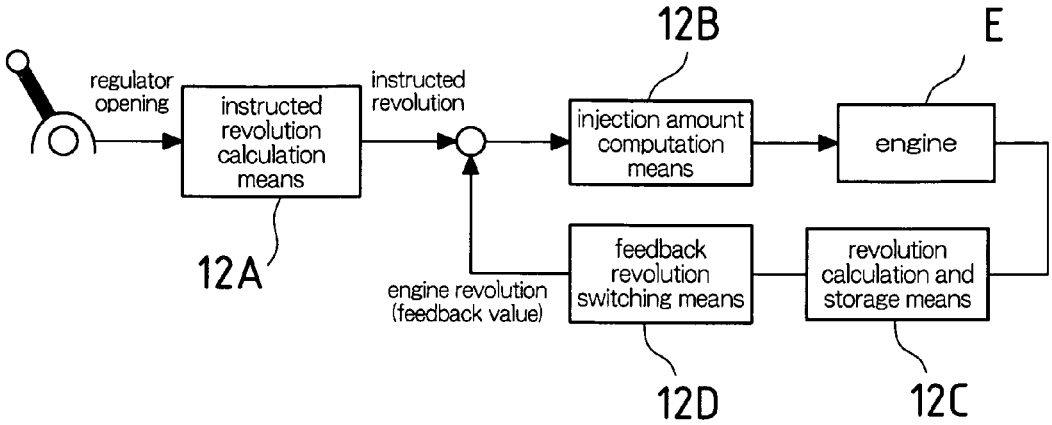
FIG. 2 is a control block diagram for determining the fuel injection amount.

FIG. 2 is a control block diagram of the controller 12 for determining the fuel injection amount. As shown in FIG. 2, to calculate the fuel injection amount, instructed revolution calculation means 12A receives a signal that indicates the degree of opening of the regulator that is actuated by the user, and the instructed revolution calculation means 12A then calculates the "instructed revolution (target revolution)" that corresponds to the degree of opening of the regulator. Then, injection amount computation means 12B calculates the fuel injection amount so that the engine revolution becomes this instructed revolution. The injectors 1 of the engine E perform the fuel injection operation with the fuel injection amount that has been found through this computation, and in this state, revolution calculation and storage means 12C calculates the actual engine revolution and compares this actual engine revolution with the instructed revolution and corrects the fuel injection amount (engine revolution feedback control) so that the actual engine revolution approaches the instructed revolution. Here, the revolution calculation and storage means 12C calculates the engine revolution in the expansion stroke of a cylinder from the time that is required for the crank shaft to rotate by a predetermined angle from the compression upper dead center of that cylinder, and stores this in association with that cylinder number. It also temporarily stores the calculated revolution for a fixed number of cylinders.

—How the Feedback Revolution is Switched in the Fuel Injection Control—

Next, the manner in which the feedback revolution is switched in this fuel injection control, which is a characteristic aspect of the embodiment, is described. The aspect that is characteristic of this embodiment is that, in regard to taking the feedback revolution of the fuel injection control as the average revolution from the cylinder immediately prior to a cylinder that is prior to this, the number of past cylinders to be retroactively averaged is switched according to the engine operation state. The following description pertains to the structure, and the operation thereof, for switching the feedback revolution in this fuel injection control.

As shown in FIG. 1, the injection amount computation means 12B of the controller 12 is furnished with feedback revolution switching means 12D. The controller 12 is also furnished with target revolution determination means 12E, load fluctuation determination means 12F, and reduced cylinder operation determination means 12G.

The feedback revolution switching means 12D receives the output from these determination means 12E to 12G and from these signals that it receives it determines how many past cylinders should be included to find the main engine revolution and switches the feedback revolution to cause the injection amount computation means 12B to execute a control operation (calculation operation) for determining the fuel injection amount.

An engine revolution signal is input to the controller 12 from engine revolution detection means 100, and when the revolution calculation and storage means 12C receives this engine revolution signal that has been input, it calculates the engine revolution and temporarily stores this calculated revolution in association with the cylinder number for a fixed number of cylinders.

Then, in regard to determining the fuel injection amount based on the target revolution that corresponds to the amount by which the regulator is open, the revolution that is obtained by averaging these stored rotational values from the cylinder immediately prior to a cylinder before the cylinder immediately prior is fed back as the engine revolution, and from this the injection amount computation means 12B performs computations to determine the fuel injection amount.

It should be noted that the engine revolution detection means 100 employs an electromagnetic pickup-type detector to detect a plurality of projections that are formed in the outer periphery of a crank shaft synchronized rotating member, which is not shown, that is provided in a single rotating unit with the crank shaft of the engine E, and the engine revolution is calculated based on the time that is required for a predetermined number of projections to pass through the detector. In particular, the engine revolution that is used in the fuel injection control of this embodiment is calculated by the revolution calculation and storage means 12C based on the time required for rotation by a predetermined angle from a "reference point" that is the point that the compression upper dead center of a certain cylinder is reached (the time required to detect a predetermined number of projections from the reference point). It should be noted that the predetermined angle is one-half the crank angle from the compression upper dead center of one cylinder to the compression upper dead center of the next cylinder.

Next, the operation for selecting a feedback revolution that corresponds to the output from the above determination means 12E to 12G is described.

(A) The internal combustion engine is determined to be in a steady state when the target revolution determination means 12E has determined that fluctuation in the target revolution has settled and the load fluctuation determination means 12F has determined that fluctuation in the load has settled. In this case, the revolution calculation and storage means 12C feeds back the revolution this is obtained by averaging the revolution from the cylinder immediately prior to a cylinder before the cylinder immediately prior as the feedback revolution.

By selecting such a feedback revolution, fluctuations in the fuel injection amount resulting from oversensitivity to instantaneous disturbances are inhibited and thus stable engine driving becomes possible.

(B) The number of retroactive cylinders for calculating the feedback revolution is switched according to the amount of deviation between the target revolution that has been determined by the target revolution determination means 12E and the revolution of the cylinder immediately prior that has been calculated and stored by the revolution calculation and storage means 12C. At this time, if the amount of that deviation is large, then the retroactive cylinder number is reduced, that is, the revolution of more recent cylinders is reflected in the feedback revolution, and if that amount of deviation is small, then the number of retroactive cylinders is increased, that is, the revolution of more prior cylinders is reflected in the feedback revolution.

By selecting such a feedback revolution, it is possible to achieve operation state with good responsiveness in which it is possible to quickly obtain a fuel injection amount that follows the fluctuation in the target revolution that accompanies actuation of the regulator by the pilot, for example, and when there is a need for a sudden rise in engine revolution, it is possible to quickly meet that need.

(C) The load fluctuation determination means 12F detects a fluctuation in the load applied to the engine and a signal pertaining to that fluctuation is received by the feedback revolution switching means 12D, and when the load applied to the engine fluctuates, the number of retroactive cylinders for calculating the feedback revolution is switched according to the amount of that change. At this time, the retroactive cylinder number is decreased if the fluctuation amount is large, whereas the retroactive cylinder number is increased if the fluctuation amount is small.

By selecting such a feedback revolution, it is possible to rapidly obtain a fuel injection amount that follows the fluctuation in the load (in marine vessels, the engine load fluctuates quickly when the clutch is engaged and due to the effects of waves, for example). In particular, even in a situation where the load suddenly increases at a time when the engine is operating under a low turnover operation state and as a result the engine revolution suddenly drops, it is possible to maintain the engine revolution by rapidly increasing the fuel injection amount, and thus stalling can be avoided.

(D) When the reduced cylinder operation determination means 12G has determined that combustion has stopped in at least one of the cylinders, a revolution that is obtained by retroactively averaging the revolution from the cylinder immediately prior to a cylinder before that cylinder immediately prior is fed back.

By selecting such a feedback revolution, the problem of a marked increase occurring in the fuel injection amount in the cylinder immediately following a cylinder in which combustion has stopped and causing hatching of the fuel injection amount is avoided, and this allows discrepancies in the exhaust temperature among the cylinders to be eased.

(E) Further, if the number of retroactive cylinders is set to an integer multiple of the number of engine cylinders, then the revolution in the expansion stroke of all cylinders of the engine is reflected in the feedback revolution, and thus the impact of fluctuations in the rotation can be eased regardless of the target revolution and the engine load.

(F) When the engine is idling, the engine revolution of the prior cylinder immediately is fed back.

By selecting such a feedback revolution, the responsiveness to acceleration commands and fluctuation in the engine load is improved.

(G) If the fluctuation in the engine load is estimated based on the clutch disengage signal, for example, and the engine revolution of the cylinder immediately prior is fed back during a preset load correspond period, then drops in engine rotation during load fluctuation can be inhibited. In this case, the load correspond period can be freely set so that even if the period from the occurrence of load fluctuation until the engine transitions to a steady state is different among internal combustion engines due to engine type, individual differences, or wear over time, for example, it is possible to adjust individually and depending on the age.

In this way, with the current embodiment, in regard to adopting the revolution calculated as the mean revolution of the immediately prior cylinder to cylinders prior to the immediately prior cylinder as the engine revolution that is fed back in order to determine the fuel injection amount, it is possible to switch how many past cylinders should be included to calculate this mean according to the engine operation state, and by selecting this feedback revolution, it is possible to achieve a balance between increasing the responsiveness during periods of transition such as load fluctuation and when there have been commands to accelerate or decelerate, and increasing the operation stability when the engine is in a steady state.

A specific example of the operation state of the engine (fluctuation in the engine revolution speed, discrepancies in the exhaust temperature) when the control operation according to this embodiment is implemented is described below.

Figure 7:
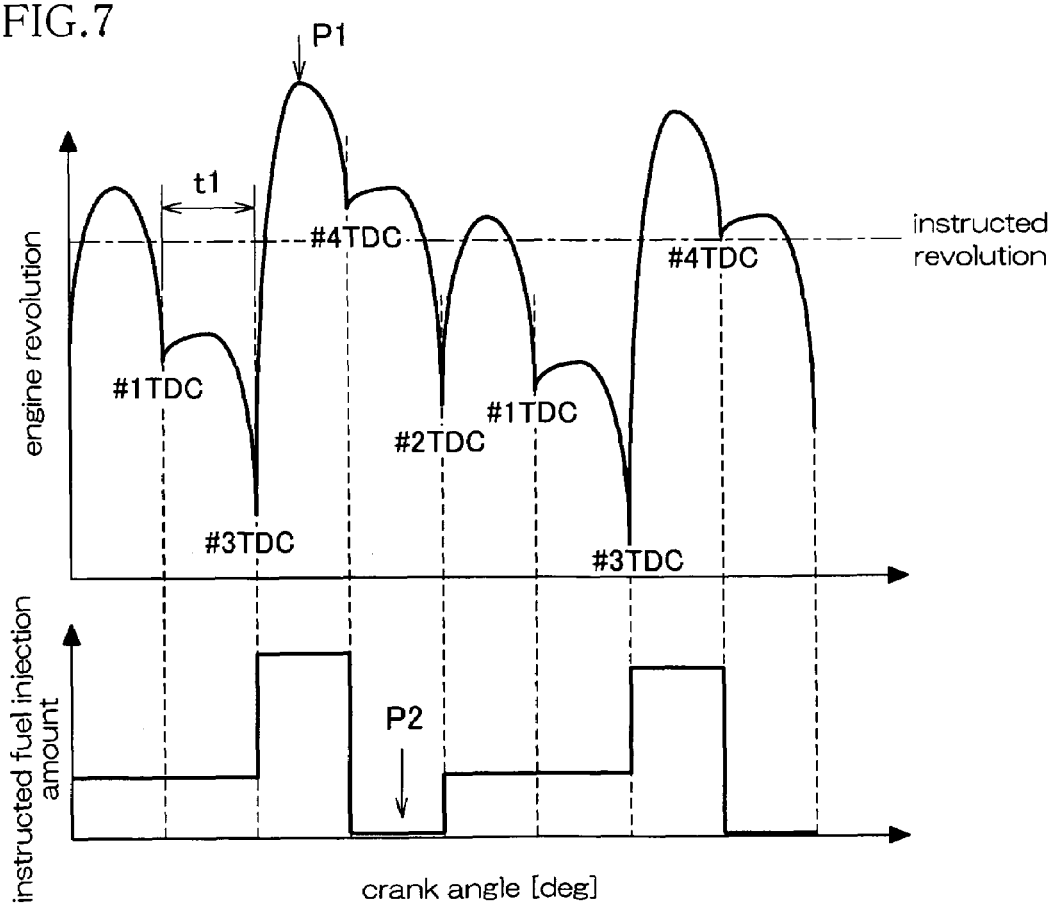
FIG. 7 is a diagram that shows the state of fluctuation in the engine revolution in a case where damage has occurred to the fuel injection valve of the first cylinder in the conventional example.

FIG. 7 shows how the engine revolution changes when, for example, a carbon flower occurs in the fuel injection valve of the first cylinder and it is not possible for fuel to be supplied to the first cylinder (=a reduced-cylinder operation state). In this diagram, "#" denotes the cylinder number, and "TDC" denotes the timing at which the piston of that cylinder reaches the compression upper dead center. As can be understood from FIG. 7, poor fuel injection in the first cylinder results in insufficient combustion in the expansion stroke (range t1 in the drawing) and this lowers the engine revolution.

Figure 3:
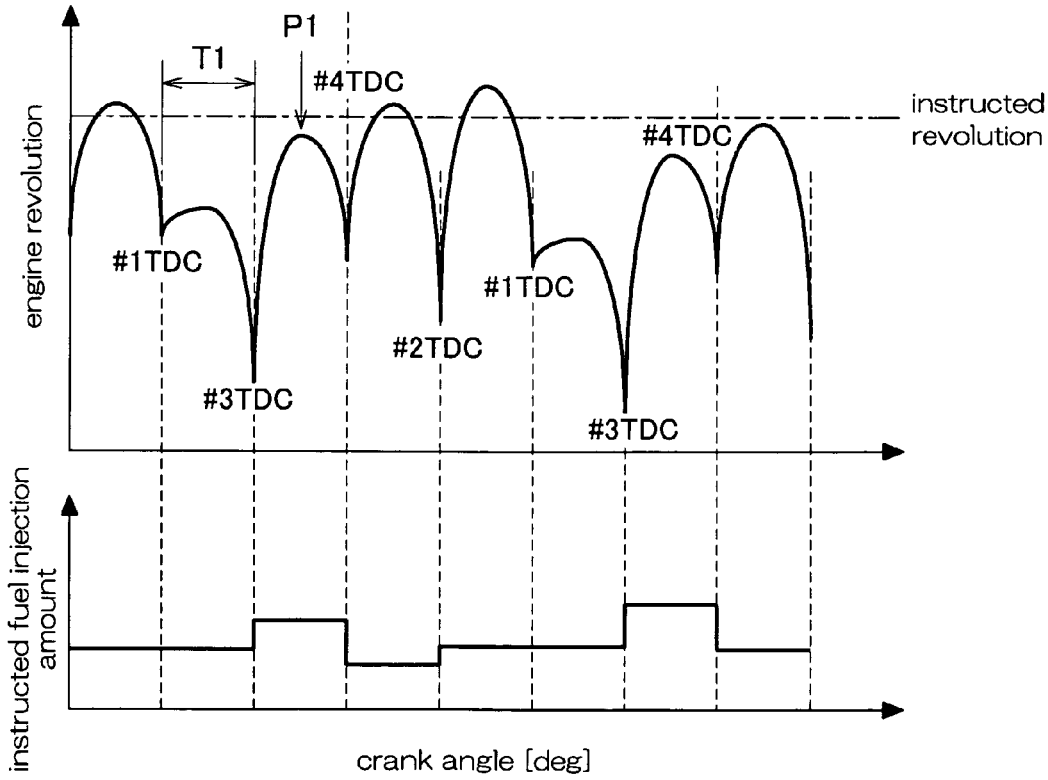
FIG. 3 is a diagram that shows how the engine revolution fluctuates in this embodiment.

FIG. 3 shows how the engine revolution changes in a case where the injector 1 of the first cylinder has become damaged and thus fuel cannot be supplied to the first cylinder. In this diagram, "#" denotes the cylinder number, and "TDC" denotes the timing at which the piston of that cylinder reaches the upper dead center. As can be understood from FIG. 3 also, poor fuel injection in the first cylinder results in insufficient combustion in the expansion stroke (range t1 in the drawing) and this lowers the engine revolution. In this case, it is determined that the engine is in reduced-cylinder operation and, as discussed above, the revolution that is obtained by averaging the revolutions from the immediately prior cylinder to a cylinder before the immediately prior cylinder is fed back. Thus, compared to the case of FIG. 7, a revolution that reflects the engine revolution of the second, fourth, and third cylinders, in which combustion is occurring normally, is fed back rather than only feeding back the reduced engine revolution in the first cylinder, and thus deviation from the target revolution can be kept from becoming excessive. Accordingly, the fuel injection amount for the third cylinder, whose expansion stroke comes next, does not increase significantly, allowing the engine revolution to be kept relatively stable (see P1 in the drawing). The same applies for the fourth cylinder and the second cylinder, which subsequently have their expansion stroke.

Figure 4:
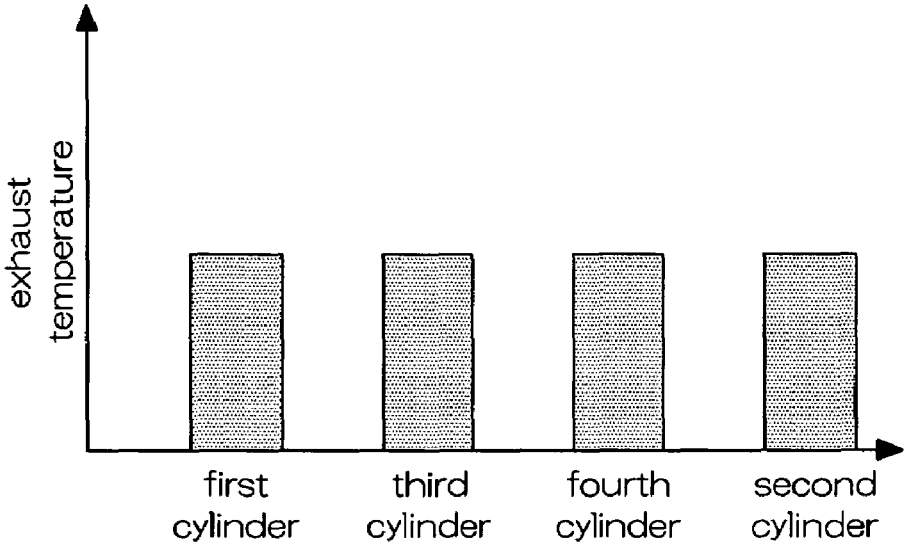
FIG. 4 is a diagram that shows the relationship between the cylinder number and the exhaust temperature in this embodiment.

FIG. 4 shows the relationship between the cylinder number and the exhaust temperature during a steady operation state. In this case as well, as discussed above, the revolution that is obtained by averaging the revolutions from the cylinder immediately prior to a cylinder before the cylinder immediately prior is fed back. Consequently, for example, even if the engine load temporarily decreases, an extreme decrease in the fuel injection amount in the cylinder whose expansion stroke follows immediately thereafter can be avoided. Thus, the fuel injection amount is kept from alternating between big and small among the cylinders, so that, as shown in FIG. 4, discrepancies in the exhaust temperatures of the cylinders can be inhibited.

Figure 5:
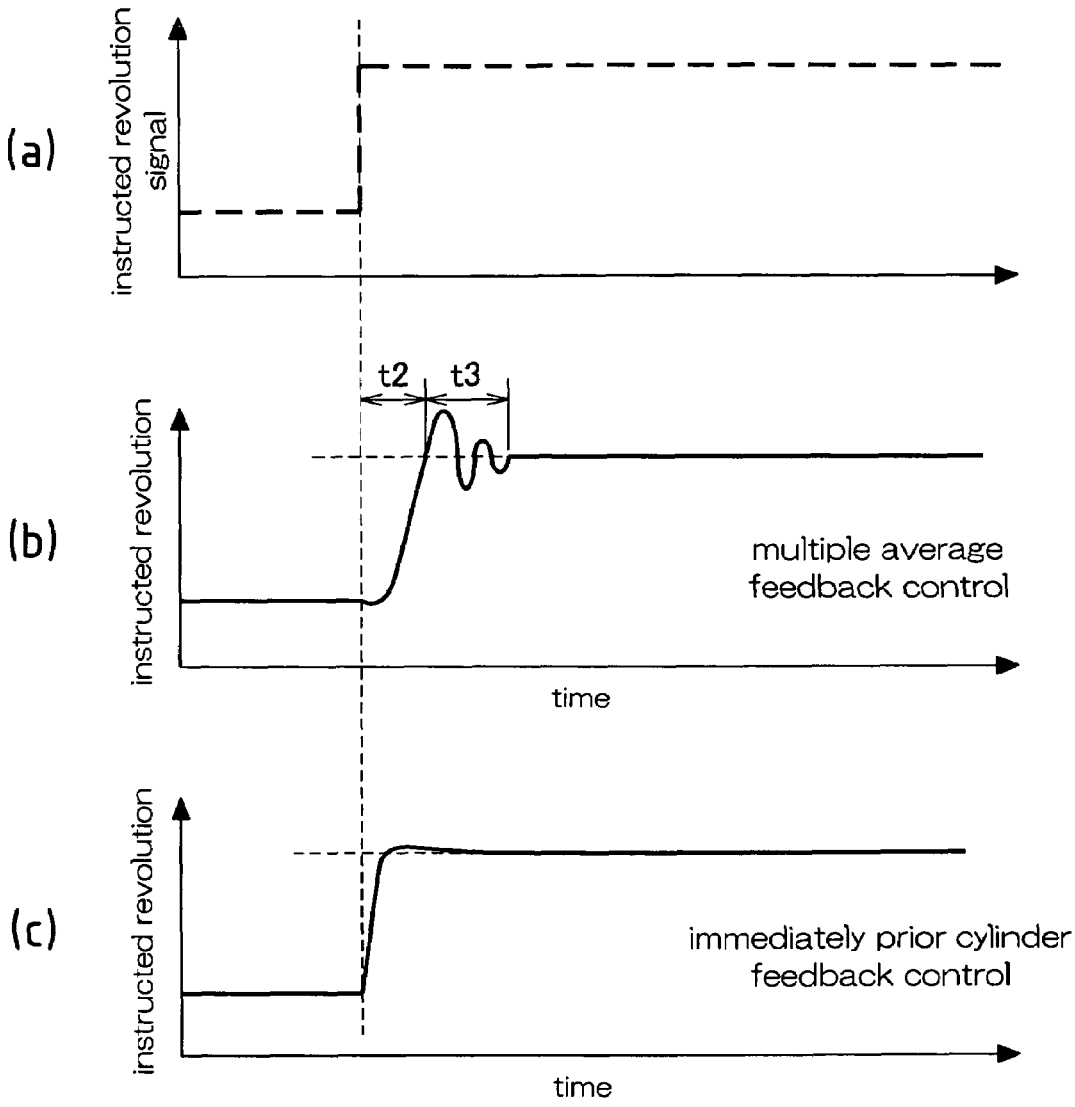
FIG. 5 is a diagram for describing the change in engine revolution when the ordered revolution suddenly rises, where FIG. 5(*a*) shows the instructed revolution signal, FIG. 5(*b*) shows the change in the engine revolution in the case of "multiple average feedback control," and FIG. 5(*c*) shows the change in engine revolution in the case of "immediately prior cylinder feedback control;"
Figure 6:
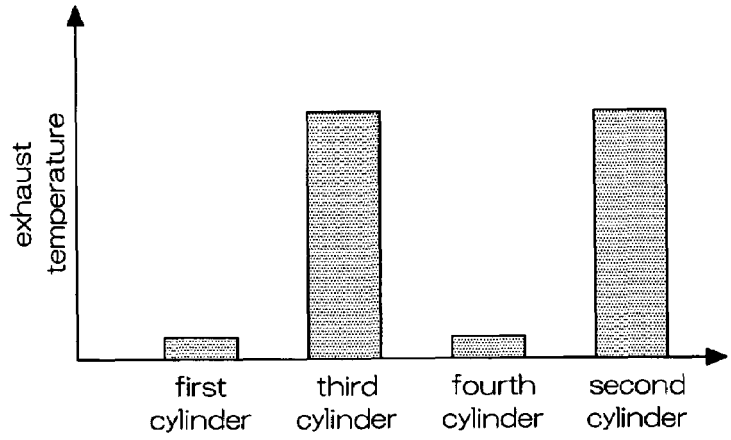
FIG. 6 is a diagram that shows the relationship between the cylinder number and the exhaust temperature in a conventional four-cylinder engine when the discrepancy in the exhaust temperature among the cylinders has become large.

FIG. 5 is a diagram for describing how the engine revolution fluctuates in a case where the instructed revolution (target revolution) suddenly rises due to operation of the regulator and in turn the number of retroactive cylinders is reduced so that the revolution that is fed back reflects the revolutions of more recent cylinders (such as only the cylinder immediately prior). It was described above how in conventional "multiple average feedback control" it was not possible to follow the target revolution if the target revolution suddenly rises (see FIG. 5(*b*)). In this embodiment, in such a situation, fuel injection control is performed by feeding back a revolution that reflects the revolutions of more recent cylinders (for example, only the cylinder immediately prior). For this reason, as shown in FIG. 5(*c*), in response to a sudden rise in the instructed revolution signal the actual instructed revolution also quickly rises with substantially no time lag, and in a short period the instructed revolution becomes stable at the proper value without fluctuating.

—Other Embodiments—

The above embodiment describes a case in which the invention is adopted for a four-cylinder marine diesel engine that is furnished with an accumulator-type fuel injection apparatus. The present invention is not limited by this, however, and it can be adopted for various engine types, including diesel engines that are not furnished with an accumulator-type fuel injection apparatus and six-cylinder diesel engines. The invention also is not limited to marine engines, and can be adopted in engines that are used in other applications such as automobiles or power generators. It should be noted that if the engine is adopted as a power generator, then the engine target revolution is a constant value.

It should be noted that the present invention can be worked in various other forms without deviating from the basic characteristics or the spirit thereof. Accordingly, the embodiments given above are in all respects nothing more than examples, and should not be interpreted as being limiting in nature. The scope of the present invention is indicated by the claims, and is not restricted in any way to the text of this specification. Furthermore, all modifications and variations belonging to equivalent claims of the patent claims are within the scope of the present invention.

Also, this application claims priority right on the basis of Japanese Patent Application 2004-204347 submitted in Japan on Jul. 12, 2004, the entire contents of which are herein incorporated by reference.

INDUSTRIAL APPLICABILITY

The present invention is useful for internal combustion engines and in particular diesel engines.

The invention claimed is:

1. A revolution control apparatus of an internal combustion engine that performs engine revolution feedback control in which an engine revolution of the internal combustion engine, which has a plurality of cylinders, is detected and a fuel injection amount from fuel injection means is controlled so that the detected engine revolution approaches a target revolution, comprising:

revolution calculation and storage means for calculating, from a time that is required for a crank shaft to rotate by a predetermined angle from a compression upper dead center of each cylinder, the engine revolution in an expansion stroke of that cylinder, and storing this in association with that cylinder number; and revolution feed and feedback revolution calculation means that, in determining the fuel injection amount based on the engine revolution that has been associated with that cylinder number and the target revolution, feeds back a revolution that is obtained by retroactively averaging the stored revolutions from the cylinder immediately prior to the cylinder before the cylinder that is immediately prior as the engine revolution, and calculates a feedback revolution by switching a number of retroactive cylinders according to an operation state of said internal combustion engine so as to control the revolution of the engine, wherein said revolution feed and feedback revolution calculation means feeds back a revolution that is obtained by averaging the revolution from the cylinder immediately prior to a cylinder before the cylinder that is immediately prior in a case where it has determined that said internal combustion engine is in a steady operation state.

2. A revolution control apparatus of an internal combustion engine that performs engine revolution feedback control in which an engine revolution of the internal combustion engine, which has a plurality of cylinders, is detected and a fuel injection amount from fuel injection means is controlled so that the detected engine revolution approaches a target revolution, comprising:

revolution calculation and storage means for calculating, from a time that is required for a crank shaft to rotate by a predetermined angle from a compression upper dead center of each cylinder, the engine revolution in an expansion stroke of that cylinder, and storing this in association with that cylinder number; and revolution feed and feedback revolution calculation means that, in determining the fuel injection amount based on the engine revolution that has been associated with that cylinder number and the target revolution, feeds back a revolution that is obtained by retroactively averaging the stored revolutions from the cylinder immediately prior to the cylinder before the cylinder that is immediately prior as the engine revolution, and calculates a feedback revolution by switching a number of retroactive cylinders according to an operation state of said internal combustion engine so as to control the revolution of the engine, wherein said revolution feed and feedback revolution calculation means switches the number of retroactive cylinders for calculating the average revolution according to an amount of deviation between the target revolution and the engine revolution of the cylinder immediately prior, and reduces the number of retroactive cylinders for calculating the average revolution if the amount of deviation is large and increases the number of retroactive cylinders for calculating the average revolution if the amount of deviation is small.

3. A revolution control apparatus of an internal combustion engine that performs engine revolution feedback control in which an engine revolution of the internal combustion engine, which has a plurality of cylinders, is detected and a fuel injection amount from fuel injection means is controlled so that the detected engine revolution approaches a target revolution, comprising:

revolution calculation and storage means for calculating, from a time that is required for a crank shaft to rotate by a predetermined angle from a compression upper dead center of each cylinder, the engine revolution in an expansion stroke of that cylinder, and storing this in association with that cylinder number; and revolution feed and feedback revolution calculation means that, in determining the fuel injection amount based on the engine revolution that has been associated with that cylinder number and the target revolution, feeds back a revolution that is obtained by retroactively averaging the stored revolutions from the cylinder immediately prior to the cylinder before the cylinder that is immediately prior as the engine revolution, and calculates a feedback revolution by switching a number of retroactive cylinders according to an operation state of said internal combustion engine so as to control the revolution of the engine, wherein said revolution feed and feedback revolution calculation means switches the number of retroactive cylinders for calculating the average revolution according to an amount of fluctuation in the engine load, and reduces the number of retroactive cylinders for calculating the average revolution if the amount of fluctuation is large and increases the number of retroactive cylinders for calculating the average revolution if the amount of fluctuation is small.

4. A revolution control apparatus of an internal combustion engine that performs engine revolution feedback control in which an engine revolution of the internal combustion engine, which has a plurality of cylinders, is detected and a fuel injection amount from fuel injection means is controlled so that the detected engine revolution approaches a target revolution, comprising:

revolution calculation and storage means for calculating, from a time that is required for a crank shaft to rotate by a predetermined angle from a compression upper dead center of each cylinder, the engine revolution in an expansion stroke of that cylinder, and storing this in association with that cylinder number; and revolution feed and feedback revolution calculation means that, in determining the fuel injection amount based on the engine revolution that has been associated with that cylinder number and the target revolution, feeds back a revolution that is obtained by retroactively averaging the stored revolutions from the cylinder immediately prior to the cylinder before the cylinder that is immediately prior as the engine revolution, and calculates a feedback revolution by switching a number of retroactive cylinders according to an operation state of said internal combustion engine so as to control the revolution of the engine, wherein said revolution feed and feedback revolution calculation means feeds back the revolution that is obtained by retroactively averaging the revolution from the cylinder immediately prior to a cylinder before the cylinder that is immediately prior when operating under a reduced number of cylinders.

5. A revolution control apparatus of an internal combustion engine that performs engine revolution feedback control in which an engine revolution of the internal combustion engine, which has a plurality of cylinders, is detected and a fuel injection amount from fuel injection means is controlled so that the detected engine revolution approaches a target revolution, comprising:

revolution calculation and storage means for calculating, from a time that is required for a crank shaft to rotate by a predetermined angle from a compression upper dead center of each cylinder, the engine revolution in an expansion stroke of that cylinder, and storing this in association with that cylinder number; and revolution feed and feedback revolution calculation means that, in determining the fuel injection amount based on the engine revolution that has been associated with that cylinder number and the target revolution, feeds back a revolution that is obtained by retroactively averaging the stored revolutions from the cylinder immediately prior to the cylinder before the cylinder that is immediately prior as the engine revolution, and calculates a feedback revolution by switching a number of retroactive cylinders according to an operation state of said internal combustion engine so as to control the revolution of the engine, wherein said revolution feed and feedback revolution calculation means feeds back the engine revolution of the cylinder immediately prior when the internal combustion engine is idling.

6. A revolution control apparatus of an internal combustion engine that performs engine revolution feedback control in which an engine revolution of the internal combustion engine, which has a plurality of cylinders, is detected and a fuel injection amount from fuel injection means is controlled so that the detected engine revolution approaches a target revolution, comprising:

revolution calculation and storage means for calculating, from a time that is required for a crank shaft to rotate by a predetermined angle from a compression upper dead center of each cylinder, the engine revolution in an expansion stroke of that cylinder, and storing this in association with that cylinder number; and revolution feed and feedback revolution calculation means that, in determining the fuel injection amount based on the engine revolution that has been associated with that cylinder number and the target revolution, feeds back a revolution that is obtained by retroactively averaging the stored revolutions from the cylinder immediately prior to the cylinder before the cylinder that is immediately prior as the engine revolution, and calculates a feedback revolution by switching a number of retroactive cylinders according to an operation state of said internal combustion engine so as to control the revolution of the engine, wherein said revolution feed and feedback revolution calculation means switches the number of retroactive cylinders for calculating an average revolution in accordance with an engine load, and wherein said revolution feed and feedback revolution calculation means feeds back the engine revolution of the cylinder immediately prior during a predetermined load correspond period if it has estimated the fluctuation in the engine load.

7. The revolution control apparatus of an internal combustion engine according to claim 6, wherein said load correspond period can be set freely.

8. An internal combustion engine comprising any one revolution control apparatus according to any one of claims 1-4 and 5-7.

* * * * *